United States Patent [19]

Ediriwira

[11] 4,394,843

[45] Jul. 26, 1983

[54] SELF-RIGHTING TRAFFIC MARKER

[76] Inventor: Gananath W. Ediriwira, 29, Cloister Rd., Acton W.3 London, England

[21] Appl. No.: 222,323

[22] Filed: Jan. 5, 1981

[51] Int. Cl.[3] ..... E01F 9/01

[52] U.S. Cl. ..... 116/63 P; 40/608

[58] Field of Search ..... 116/63 P, 63 C, 63 T; 40/608

[56] References Cited

U.S. PATENT DOCUMENTS

| | | | |
|---|---|---|---|
| 1,228,615 | 6/1917 | Stafford | 40/608 |
| 2,002,756 | 5/1935 | Segelhorst | 116/63 P |
| 2,104,762 | 1/1938 | Riner | 46/155 |
| 2,333,273 | 2/1943 | Scanlon | 116/63 R |
| 3,289,555 | 12/1966 | Steenberg | 40/612 |
| 3,499,413 | 3/1970 | Heard | 116/63 P |
| 3,699,913 | 10/1972 | Sautbine | 116/63 P |
| 3,805,444 | 4/1974 | Adickes | 46/155 |
| 4,083,033 | 4/1978 | Kulp et al. | 116/63 P X |
| 4,117,455 | 9/1978 | Cervantes | 40/608 X |

*Primary Examiner*—Daniel M. Yasich

*Attorney, Agent, or Firm*—Brisebois & Kruger

[57] ABSTRACT

A portable self-righting traffic marker comprises a generally rigid body having a base on which the marker can rock and includes an outwardly flaring region merging with an integral upper part. The base is so weighted that in use the marker returns to its upright position by itself when it is knocked over.

4 Claims, 2 Drawing Figures

SELF-RIGHTING TRAFFIC MARKER

BACKGROUND OF THE INVENTION

The present invention relates to traffic markers and, more particularly, to self-righting traffic markers which return to their normal erect position after being knocked over.

One kind of portable marker or road sign currently in use is the coloured, e.g. red and white, traffic cone. However, this cone has a number of disadvantages. For example, it is easily toppled over by passing vehicles; it can be blown away by the wind, the upper part of the cone becomes increasingly narrow so as to become less clearly visible and therefore less efficient as a warning sign; and the warning display area is small in proportion to the road space occupied by its base.

An object of the present invention is to provide a simple but efficient portable traffic marker which reduces or eliminates at least some of the disadvantages associated with the traffic cone.

SUMMARY OF THE INVENTION

The present invention consists in a portable self-righting traffic marker comprising a generally rigid body having a base on which the marker can rock and including an outwardly flaring region merging with an integral upper part, said base being so weighted or adapted to be so weighted in use that the marker returns to its upright position by itself when it is knocked over.

Conveniently, the upper part of the marker is hollow, at least in part, and has an open top so that a plurality of markers can be stacked together. Further, the sides of the upper part of the marker may be provided with apertures to lower the wind resistance of the upper part and/or to allow rainwater collected within the upper part to drain out of the upper part.

BRIEF DESCRIPTION OF THE DRAWINGS

In order that the invention may be more readily understood, as well as the objects and advantages thereof, reference will now be made, by way of example, to the accompanying drawings, in which.

DESCRIPTION OF THE PREFERRED EMBODIMENTS

Figure 1:
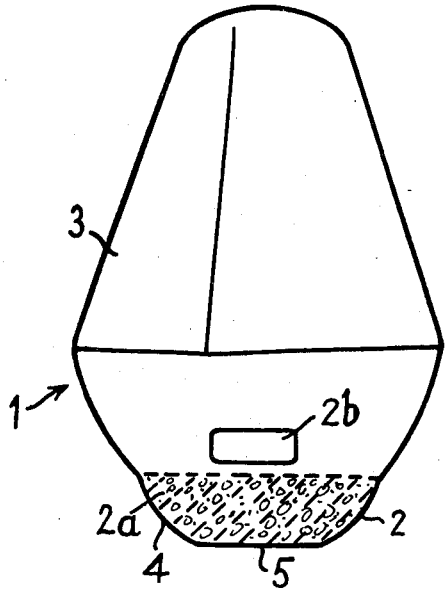
FIG. 1 is a perspective view of one embodiment of traffic marker according to the invention.

Referring to FIG. 1, a portable self-righting traffic marker comprises a body 1 of a light material, for example a plastics material such as polyvinylchloride or polyethylene, having a weighted base 2 and a comparatively lighter generally pyramid shaped upper part 3. The outer surface 4 of the base 2 of the body may be sloped, curved, generally part-spherical, e.g. semi-spherical, or otherwise shaped so that the marker can rock thereon, and the bottom of the base is provided with a flat portion 5 which facilitates standing the marker on the ground in the upright position.

The base may be weighted in any convenient manner e.g. by pouring concrete or another heavy coherent material into the base, as represented by the shading *2a*. Alternatively, the base may comprise a separate compartment having a closable aperture *2b* for example in the side of the base, via which sand, soil, water or other heavy material can be introduced into the base.

In use, when the marker is knocked over the weight and shape of the base allow the marker to rock on the base and return to its upright position as shown in FIG. 1.

Figure 2:
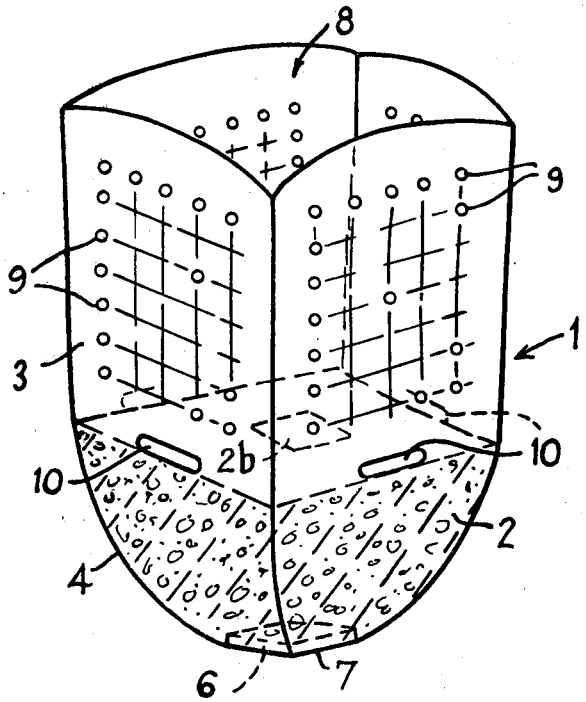
FIG. 2 is a perspective view of a further embodiment.

FIG. 2 shows a second embodiment of traffic marker comprising a body 1 which may be made of a similar material as the embodiment described above, and which has a weighted base 2 and a comparatively lighter upper part 3. Again the outer surface 4 of the base 2 may be sloped, curved, generally part-spherical, e.g. semi-spherical, or otherwise shaped so that the marker can rock thereon. The bottom of the base includes a recess 6, the peripheral edge of which provides a land 7 which facilitates standing the marker on the ground in the upright position.

The upper part 3 is generally rectangular in shape and increases in its lateral dimensions from the top of the base to the top of the upper part. Two of the opposing sides or walls of the upper part are slightly taller than the remaining two sides. The upper part 3 is hollow and has an open top 8. The sides of the upper part 3 may be provided with apertures or perforations 9 which lower the wind resistance of the upper part. In addition, apertures 10 serving as rain vents may be provided in the sides of the upper part a short distance above the base through which rain water which has collected within the upper part can drain.

In this embodiment, the upper part is so designed that a plurality of markers can be stacked together, i.e. with the lower part of each marker being insertable into the upper part of the adjacent marker via the open top 8.

The base may be weighted in a similar manner to the base of the embodiment described above. Further in this embodiment, where a separate base compartment is provided, the closable aperture *2b* may be in the wall partitioning the base from the hollow upper part.

Again, when the marker is toppled over it returns to its upright position by virtue of the weight and shape of the base on which the marker can rock.

It will be appreciated that either embodiment of marker shown in the Figures may be of another shape, for example, the upper part and/or the opening in the top of the upper part may be square, round, triangular, hexagonal or of other polygonal shape in plan view.

The marker may also carry information or the like for road users or pedestrians. For example, the markers may bear warning stripes and/or indicate speed limits. Alternatively, or in addition, the markers may be provided with reflectors, cats-eyes, or warning lights.

I claim:

1. A portable self-righting traffic marker comprising:

a generally rigid body having a base on which the marker can rock and an integral rigid upper part, an outwardly flaring multi-faced region merging said base with said integral upper part, said integral rigid upper part of said body comprising a plurality of contiguous generally flat outwardly flaring side wall portions which define a nesting facility, formed as a hollow upper region having an open top, whereby a plurality of said traffic markers can be nested, one within the other, weight means for selectively weighting said base so that said marker returns to its upright position by itself when it is knocked over, land means on the bottom of said base for facilitating standing the marker on the ground in its upright position, and drain means for draining rain water entering said body through said open top.

2. A marker as defined in claim 1, in which said base is formed with a separate compartment having a closable aperture via which material to weight the base can be introduced into the base, and in which said closable aperture is provided in a wall partitioning said base from said hollow upper region.

3. A traffic marker as defined in claim 1, further comprising means in said rigid upper part for reducing the wind resistance of said traffic marker.

4. A traffic marker as defined in claim 1, wherein said land means comprises the edge of a recess in the bottom of said base.

* * * * *